US008322428B2

(12) United States Patent
Jennings

(10) Patent No.: US 8,322,428 B2
(45) Date of Patent: Dec. 4, 2012

(54) CASING HANGER NESTING INDICATOR

(75) Inventor: Charles E. Jennings, Tomball, TX (US)

(73) Assignee: Vetco Gray Inc., Houston, TX (US)

( * ) Notice: Subject to any disclaimer, the term of this patent is extended or adjusted under 35 U.S.C. 154(b) by 347 days.

(21) Appl. No.: 12/577,028

(22) Filed: Oct. 9, 2009

(65) Prior Publication Data

US 2011/0083854 A1 Apr. 14, 2011

(51) Int. Cl.
*E21B 23/00* (2006.01)
*E21B 47/00* (2012.01)

(52) U.S. Cl. ..... 166/338; 166/341; 166/348; 166/352; 166/250.01; 166/85.1; 340/854.1; 340/854.3

(58) Field of Classification Search ..... 166/338, 166/341, 348, 351, 352, 360, 367, 368, 250.01, 166/255.1, 255.2, 381, 382, 85.1, 85.3; 702/6, 702/66; 340/853.1, 854.1, 854.3
See application file for complete search history.

(56) References Cited

U.S. PATENT DOCUMENTS 3,664,442 A * 5/1972 Rosser et al. ..... 175/231
4,862,426 A * 8/1989 Cassity et al. ..... 367/81
5,420,905 A 5/1995 Bertozzi
5,666,050 A * 9/1997 Bouldin et al. ..... 324/207.26
6,359,569 B2 * 3/2002 Beck et al. ..... 340/856.3
6,478,087 B2 * 11/2002 Allen ..... 166/255.1
6,529,842 B1 * 3/2003 Williams et al. ..... 702/66
6,588,505 B2 * 7/2003 Beck et al. ..... 166/250.17
6,668,919 B2 * 12/2003 Radi ..... 166/208
6,725,924 B2 * 4/2004 Davidson et al. ..... 166/250.01
6,751,564 B2 * 6/2004 Dunthorn ..... 702/66
6,815,945 B2 * 11/2004 Biester et al. ..... 324/207.24
6,898,968 B2 * 5/2005 Biester et al. ..... 73/168
7,274,989 B2 * 9/2007 Hopper ..... 702/6
7,301,473 B2 * 11/2007 Shah et al. ..... 340/854.4
7,318,480 B2 * 1/2008 Hosie et al. ..... 166/367
7,401,506 B2 * 7/2008 Kunow et al. ..... 73/161
7,513,308 B2 * 4/2009 Hosie et al. ..... 166/338
7,762,338 B2 * 7/2010 Fenton et al. ..... 166/348
7,779,916 B2 * 8/2010 Zemlak et al. ..... 166/336
2006/0000605 A1 * 1/2006 Jordan et al. ..... 166/255.1
2008/0137481 A1 * 6/2008 Shah et al. ..... 367/82

* cited by examiner

*Primary Examiner* — Matthew Buck
(74) *Attorney, Agent, or Firm* — Bracewell & Giuliani LLP

(57) ABSTRACT

A casing hanger nesting indicator generates a signal to notify personnel on the surface that a wellhead member has properly landed on a predetermined surface within the wellbore. The casing hanger nesting indicator comprises a signaling device such as an explosive charge or a frequency shift key wherein the noise or vibration of the signaling device travels through the wellbore, via the drilling conduit in some embodiments, up to the surface platform.

18 Claims, 10 Drawing Sheets

CASING HANGER NESTING INDICATOR

BACKGROUND OF THE INVENTION

1. Field of the Invention

The present invention relates in general to a method and apparatus to signal the proper landing of a wellbore tool on a surface, and in particular to pyrotechnic and frequency tone signals to indicate the proper landing of a casing hanger or seal ring.

2. Brief Description of Related Art

When oil production casing is run down hole on casing hangers and landed on the high pressure wellhead housing, either on the lower load shoulder or nested above on the shoulder of a previously landed casing hanger, the hanger must be fully down on the load bearing shoulder for the seal to be at the proper elevation to engage the sealing and locking wicker grooves. It is useful for the crew running the casing to know if the hangers are landed on the shoulders or if the casing is stuck in the wellbore, landed but out of position on the landing sub, or properly landed on the landing sub.

SUMMARY OF THE INVENTION

Various embodiments of this invention provide a way to produce a signal when the casing hanger is properly landed. In an exemplary embodiment, the signal is an audible signal that is generated upon successful landing. The signal may be generated in a variety of ways, including, for example, the report of a pyrotechnic discharge or a frequency tone that resonates along the drill string. Either signal may travel up the wellbore and be heard by the crew that is running the casing.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 1:
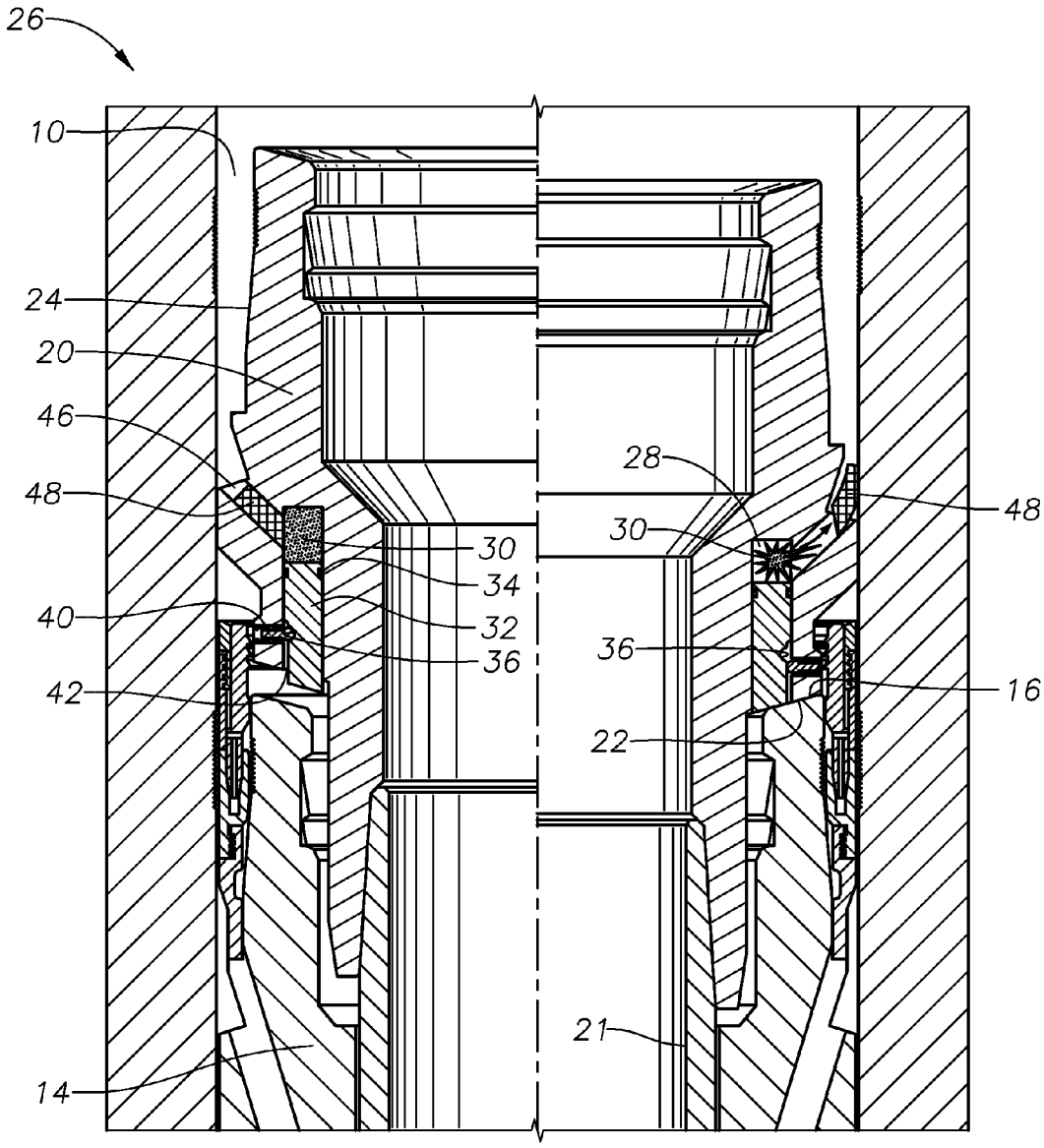
FIG. 1 is a sectional view of an exemplary embodiment of a pyrotechnic nesting indicator.

Referring to FIG. 1, wellhead housing 10 has a landing support structure (not shown) that supports outer casing hanger 14. Wellhead housing 10 is located on a sea floor and connected to a drilling vessel by a riser (not shown). Outer casing hanger 14 has a tapered shoulder with support surface 16. An inner casing hanger 20 is lowered through the wellbore until it lands on outer casing hanger 14. Load bearing shoulder 22 of inner casing hanger 20 lands on the support surface 16.

Casing hanger 20 supports inner casing string 21 in the wellbore. The lower portion of casing hanger 20 is tapered to fit inside lower casing hanger 14. The load bearing shoulder 22 is a conical shoulder that slopes inward such that the widest portion is higher than the narrowest portion. The outer diameter ("OD") of the upper portion of casing hanger 20 forms a sealing surface 24. The sealing surface 24 may have a generally smooth surface or may have a grooved surface.

In an exemplary embodiment of a casing hanger nesting indicator, pyrotechnic nesting indicator 26 is used to signal the landing of casing hanger 20. One or more charge bores 28 are drilled or machined through load bearing shoulder 22. The charge bores 28 may have a cylindrical shape and may extend along an axis parallel to the axis of the casing hanger 20, but any shape and any orientation may be used. The lower end of each charge bore 28 is open and the upper end closed.

The upper portion of charge bore 28 contains a charge 30. The charge may be any explosive material that detonates by impact or pressure. In an exemplary embodiment, charge 30 is made of potassium chlorate, sulfur, and sand, all bound together with a starch binder.

In bore 28, below charge 30, sits plunger 32. Plunger 32 has a generally cylindrical shape and can be made from a variety of materials, including steel. In its travel position, plunger 32 protrudes below the load bearing shoulder 22. It could protrude by ⅜", but it could also protrude by more or less.

Plunger 32 has a seal groove 34 around its circumference. Seal groove 34 can be at any point above the detent notch 36 on the axis of the plunger 32. Some embodiments may not have detent notch 36, and thus the seal groove can be at any point along the axis of plunger 32. Seal groove 34 contains a seal such as an elastomer seal that keeps water from reaching charge 30.

In an exemplary embodiment casing hanger 20 has detent 40. The detent is a spring loaded pin with a round head that protrudes from casing hanger 20 into charge bore 28. Plunger 32 has a detent notch 36 that receives detent 40. Detent notch 36 receives detent 40 to retain plunger 32 in the lower position until it lands on shoulder 22.

Below detent notch 36 is detent key-way 42. Detent key-way 40 is a vertical slot milled into the side of plunger 32 that extends from the bottom of plunger 32 to detent notch 36. The depth of detent key-way 42 is less than the depth of detent notch 36.

Detent 40 fits in detent notch 36 to prevent plunger 32 from falling out while casing hanger 20 is being lowered through the wellbore. When the casing hanger reaches the landing sub or other casing hanger 14, the plunger hits support surface 16 of casing hanger 14 or landing sub, pushing up on plunger 32 relative to casing hanger 20. The force against the plunger is sufficient to push detent 40 out of detent notch 36. As plunger 32 moves up, detent 40 continues to engage detent key-way 42, thus maintaining the axial alignment of the plunger 32.

The top of charge bore 28 is in communication with a discharge port 46. The discharge port 46 is an opening drilled through the OD of casing hanger 20 to charge bore 28. The axial location of charge bore 28 is generally above the widest point of the OD of casing hanger 20. The discharge port 46 is plugged with plug 48, which is made of a suitable water resistant material such as, for example, wax. Any water resistant material may be used.

In operation, when casing hanger 20 reaches lower casing hanger 14, the plunger 32 strikes the support surface 16. This drives the plunger 32 up relative to casing hanger 20, and thus the plunger strikes and compresses explosive charge 30. The impact of plunger 32 causes explosive charge 30 to explode. The expanding gas from the explosion exits charge bore 28 through discharge port 46, pushing plug 48 out of discharge port 46 in the process. The noise generated by the explosion travels out of the now-open discharge port 46 and may travel up the wellbore. The crew on the rig above the wellbore may be able to hear the report of the explosive charge. Also, casing hanger 20 is lowered on a conduit, such as drill pipe, which secures to casing hanger 20 with a running tool. The crew may be able to feel vibrations in the drill pipe created by the explosion.

Figure 2:
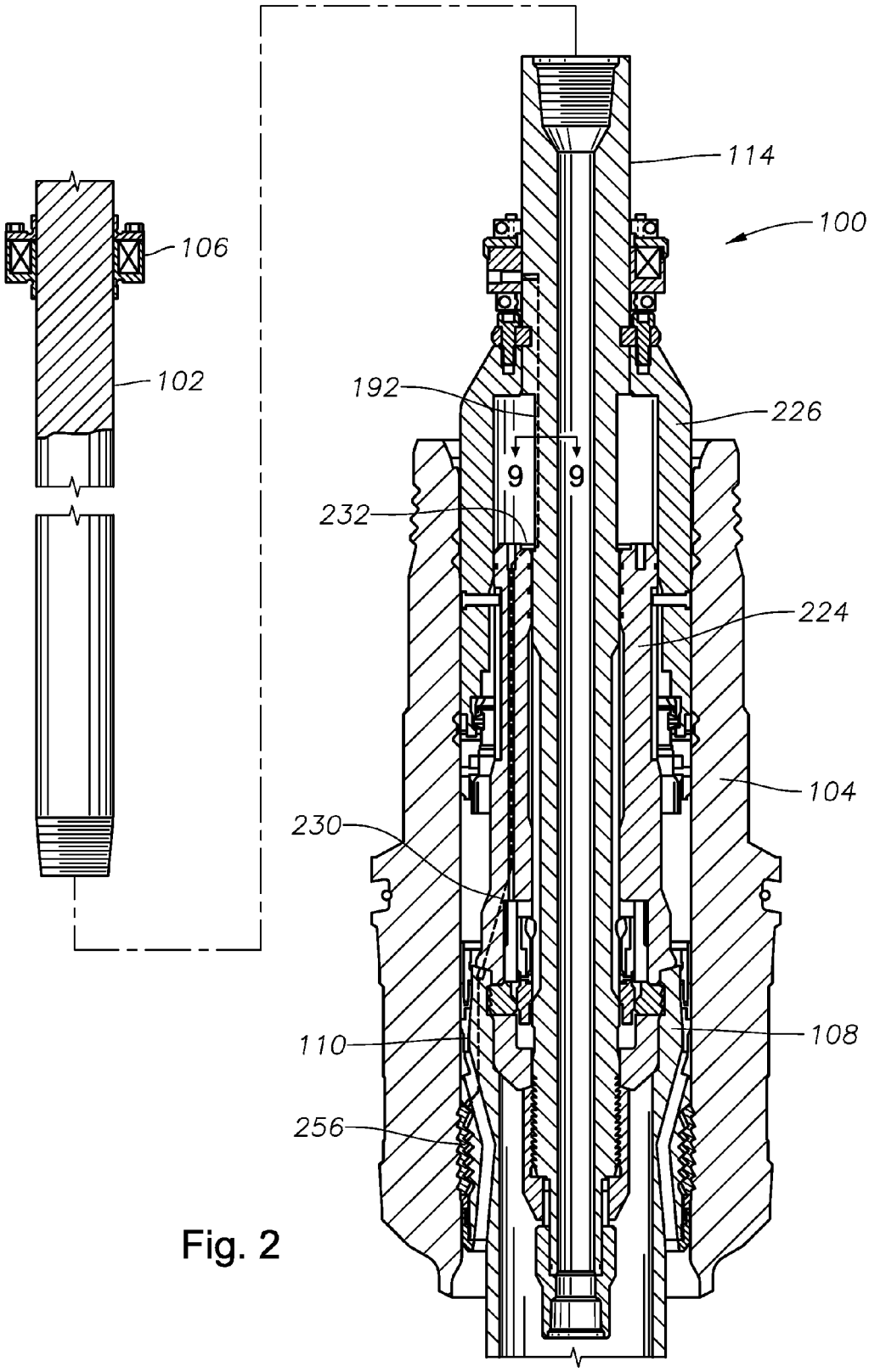
FIG. 2 is a sectional view showing an exemplary embodiment of a frequency tone nesting indicator.

Referring to FIG. 2, in an alternative embodiment, frequency tone generator-transmitter assembly 100 may transmit a signal such as a frequency shift key ("FSK") through the drill string 102 to an operator on the surface above the well to indicate that wellbore fixture is properly landed on a surface inside the wellbore, such as on wellhead housing 104. The operator on the surface may be able to hear the audible signal resonating from the drill string. Surface transceiver 106 may be used to receive the signal at or near the surface. The wellbore fixture could be a wellbore bushing, such as casing hanger 108, or seal 110.

Figure 3:
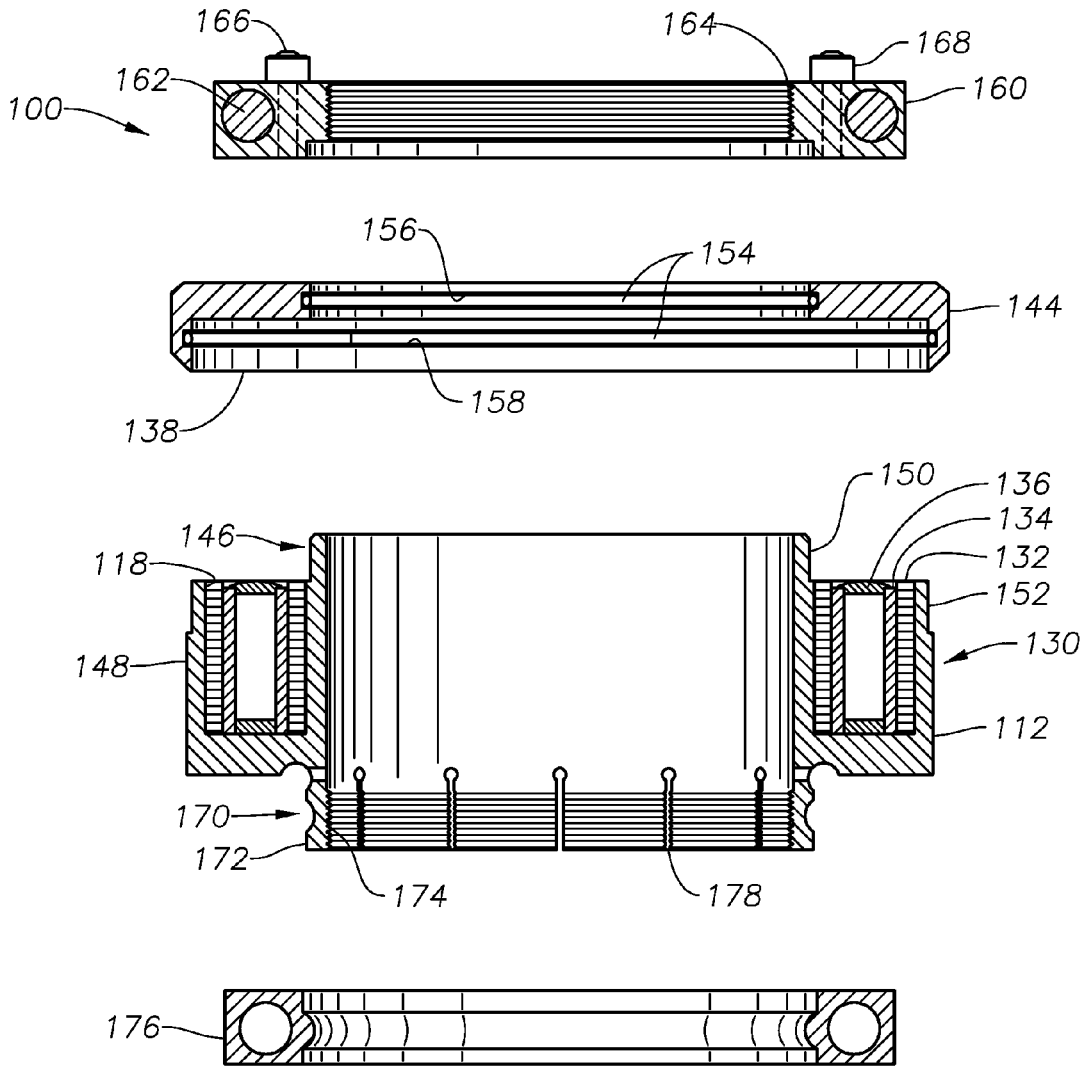
FIG. 3 is a sectional view of the signal ring of the frequency tone nesting indicator of FIG. 2.
Figure 4:
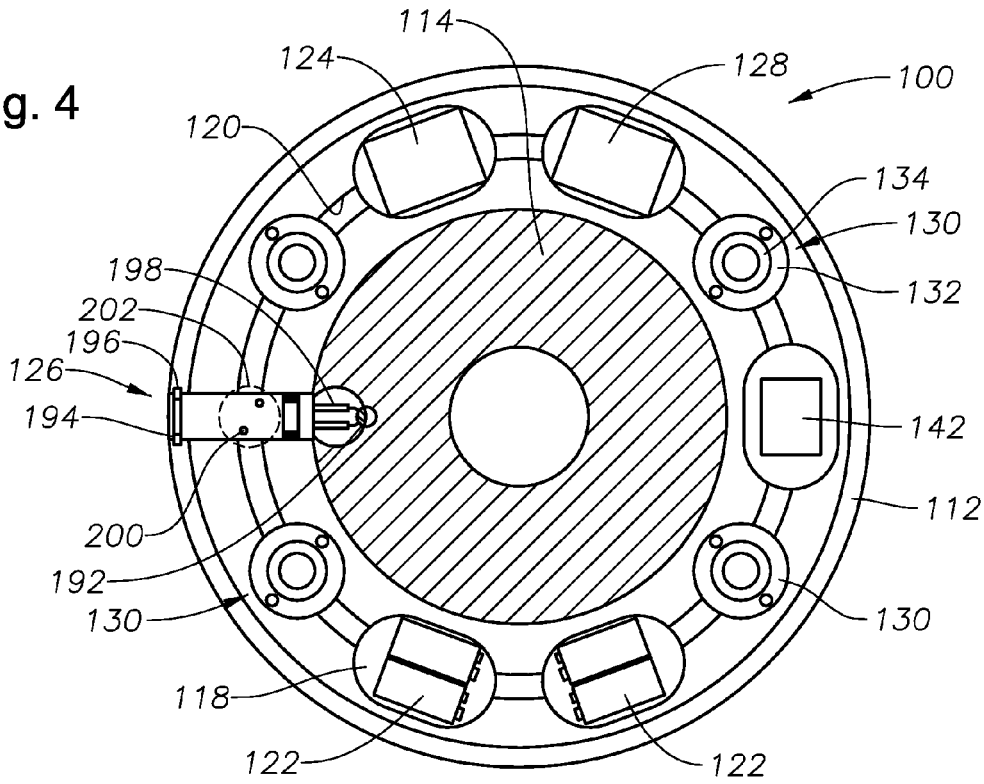
FIG. 4 is a top view of the signal ring of the frequency tone nesting indicator of FIG. 2.

Referring to FIGS. 3 and 4, signal generator-transmitter ring assembly 100 comprises ring housing 112 (FIG. 4) that slides over running tool stem 114 (FIG. 2). Running tool stem 114 attaches to, and becomes part of, the drill string 102 (FIG. 2). Ring housing 112 could be made out of any material, including steel, aluminum, polymer, and the like. Ring housing 112 may be have a generally annular shape, with an outer diameter ("OD") that is several inches larger than the inner diameter ("ID"). The ID is slightly larger than the OD of running tool stem 114 (FIG. 2). The area between ring housing 112 OD and ID may be generally solid, with the exception of one or more cavities 118 that contain signal components. In an exemplary embodiment, several cavities 118 are distributed axially around cylindrical ring housing 112. The cavities may 118 be joined by circumferential wire channel 120 (FIG. 4) that could be used to house wires connecting components located in each of the cavities 118. Each cavity 118 may contain a single type of component, or multiple components may be located in a cavity 118.

One or more of the cavities 118 may contain power supply 122 (FIG. 4). Power supply 122 could be, for example, batteries. In an exemplary embodiment, the power supply 122 is a set of ten 9-volt batteries arranged in two groups of five. Each set of five batteries is connected in series to produce 45 volts. The two sets of five may be connected in parallel to produce a higher current of electricity, such as, for example, 490 mAH each to give a combined electric charge of 980 mAH. Other types of batteries or power supplies may be used, which could provide higher or lower electric charges.

One or more of the cavities 118 may contain a wave form generator 124 having an adjustable frequency. Wave form generator 124 may produce a signal such as a square-wave signal. In some embodiments, wave form generator also has a current source that provides power to connector 126. As will be described in detail below, electricity flows through connector 126 at various rates depending on conditions such as whether casing hanger 108 is landed, seal 110 is in position, or seal 110 is energized (set). When current flows through connector 126 at a first rate, wave form generator 124 produces a signal having a first frequency. When electricity flows at a second and third rate, wave form generator 124 produces a signal having a second and third frequency, respectively.

One or more of cavities 118 may contain signal amplifier 128 (FIG. 4). In an exemplary embodiment, signal amplifier 128 takes the signal from wave form generator 124 and amplifies the voltage, current, or both. The signal from wave form generator 124 or amplifier 128 may be used to drive transmitter 130 (FIG. 4).

One or more cavities 118 on the signal ring may contain transmitter 130. Transmitter 130 generates tones, some of which may be able to reach the surface. The tones may reach the surface by, for example, resonating along the drill string 102 and reaching the surface as an audible tone such as an FSK or a vibration through liquid in the well. In an exemplary embodiment, an electrical signal from amplifier 128 energizes coil 132, which could be, for example a copper coil wound to form a cylinder. The energized coil 132 creates a magnetic field. Some embodiments may have two, three, or four transmitters 130, but a single transmitter 130 or more than four transmitters 130 may be used.

Magnetostrictive material 134 is a material such as Terfenol, that changes shape in response to a magnetic field. Magnetostrictive material 134 may be located within the inner diameter of coil 132. Magnetorestrictive material 134 could have, for example, a cylindrical shape. The magnetic field generated by coil 132 causes the magnetorestrictive material 134 to expand, which drives hammer cap 136 (FIG. 3) against an adjacent surface 138 (FIG. 3). The hammer cap 136 (FIG. 3) may be made of a metal that retains its shape when subjected to repeated stress, such as, for example, berrylium copper. The magnetic field is cycled on and off at a given frequency by wave form generator 124, causing magnetorestrictive material 134 to drive hammer cap 136 at a corresponding frequency. In an exemplary embodiment copper coil 132 generates the magnetic field, which causes magnetorestrictor 134 to drive cap 136 against adjacent surface 138.

The frequency generated by wave form generator 124, and thus transmitted by transmitter 130, may vary. Some frequencies are better able to travel through the drill string than other frequencies. The optimal tone frequency, however, is subject to change depending on the components of the drill string, distance to the surface, and presence of other materials (i.e. water or mud) around the drill string. In some embodiments, wave form generator 124 is able to generate a variety of frequencies within a range of frequencies. A typical range of frequencies could be, for example, 500 Hz to 1800 Hz, but higher frequencies such as up to 10 kHz or 20 kHz may be used. Higher frequencies may result in more interpretation errors, however, as signals resonate up the drill string. Some embodiments may have a maximum frequency of approximately 1700 kHz.

In some embodiments, receiver 142 (FIG. 4), which may be located in one of the cavities 118, is able to detect tonal vibrations in the drill string 102. When a frequency tone from transmitter 130 reaches the surface, surface transceiver 106 (which will be described more fully in the text accompanying FIGS. 5-7) may generate a confirmation signal, wherein the confirmation signal travels along the drill string from the surface to signal ring 100. Receiver 142 may use the confirmation tone to confirm that the tone from transmitter 130 reached the surface. Alternatively, receiver 142 may analyze a tone from the surface and then generate a signal to wave form generator 124 so that wave form generator 124 can create a comparable frequency to transmit through the transmitter 130. Surface transmitter may transmit a range of frequencies until receiver 142 detects a frequency. In some embodiments, surface transmitter begins transmitting at 500 Hz and transmits up to 1800 Hz or more. Receiver 142 may be contained in the same cavity and electronics package as wave form generator 124, may be located with other components within signal ring housing 100, or may be located in its own cavity 118.

Cavity 118 or cavities 118 that contain components may be sealed by a variety of means. Referring to FIG. 3, plate 144 could be secured over cavities 118, or cavities 118 could be filled with epoxy, or any other means could be used to protect the contents of the cavity from the well-bore environment. In an exemplary embodiment, a single sealing plate 144 closes all of the cavities 118 and wire channel 120 (FIG. 4). Sealing plate 144 is a ring with an inner and outer diameter that are similar to the inner and outer diameter of signal ring housing 112.

In a preferred embodiment, signal ring housing 112 comprises upper cylinder 146 (FIG. 3) having an OD that does not extend past cavities 118, and wide cylinder 148 that contains cavities 118. Upper cylinder 146 may have sealing surface 150. Wide cylinder 148 may have sealing surface 152. Sealing surfaces 150, 152 may have a vertical orientation, as shown in FIG. 3, or they may have a generally horizontal orientation wherein both surfaces are, for example, on the top of wide cylinder 148. Sealing plate 144 comprises seals 154 to engage sealing surfaces 150, 152 on signal ring housing 112. Seals 154 may sit in inner seal groove 156 and outer seal groove 158. When sealing plate 144 is bolted onto signal ring housing 112, it forms a generally water tight seal. In an exemplary embodiment, hammer caps 136 impact surface 138 forming the bottom of sealing ring plate 144 to generate a signal.

Referring to FIGS. 2 and 3, signal ring 100 is attached to running tool 114 (FIG. 2). A variety of attachment devices may be used. Signal ring 100 could be, for example, clamped, or bolted, or otherwise attached to running tool 114. In some embodiments, the components of signal ring 100 are an integral part of running tool 114. In an embodiment using a clamp, clamp ring 160 (FIG. 3) comprises two halves of a ring. The halves are joined by horizontal bolts 162. When the bolts pull the halves together, clamp wickers 164, or teeth, clamp around tool stem 114 (FIG. 2). Vertical bolts 166 (FIG. 3) press against top of sealing ring plate 144, forcing plate 144 into a position wherein surface 138 contacts hammer caps 136. Nuts 168 may be used to lock bolts 166 in place in place against plate 144 so that bolts 166 will not vibrate loose. In a preferred embodiment, clamp ring 160 and clamp ring bolts 166 are used to attach sealing ring 144 to the top of signal ring housing 112.

The lower end 170 of the signal ring 100 may also be attached to the tool stem 114 (FIG. 2). As shown in FIG. 3, the lower end 170 may be attached by clamps, bolts, or any other means. In an exemplary embodiment, signal ring 100 has lower grooved lip 172. Lip 172 is a ring rotated about the axis of the tool stem. The ID of lip 172 may have wickers 174 or teeth to engage stem 114. Clamp ring 176 may be attached to the outside of lower groove lip 170 to apply pressure to the lower grooved lip, causing lip 172 to tighten against tool stem 114. Lower groove lip 172 may have slots 178 with drilled ends to allow a greater range of inward movement as clamp ring 176 tightens lower grooved lip 172 against the tool stem.

Thus signal ring 100 is clamped to running tool stem 114 at each end of signal ring 100. When hammer caps 136 push against surface 138, the force causes ring housing 112 to behave like an actuator by growing and relaxing axially in length between the two clamped ends, proportional to the acoustic signal.

Referring to FIG. 4, wire channel 120 is a circumferential channel in the top surface of signal ring housing 112. Channel 120 may intersect each of the cavities 118 in the ring housing. Channel 120 has a width and depth sufficient to contain wires (not shown) that run between the various components such as transmitter 130, wave form generator 124, and amplifier 128.

Figure 5:
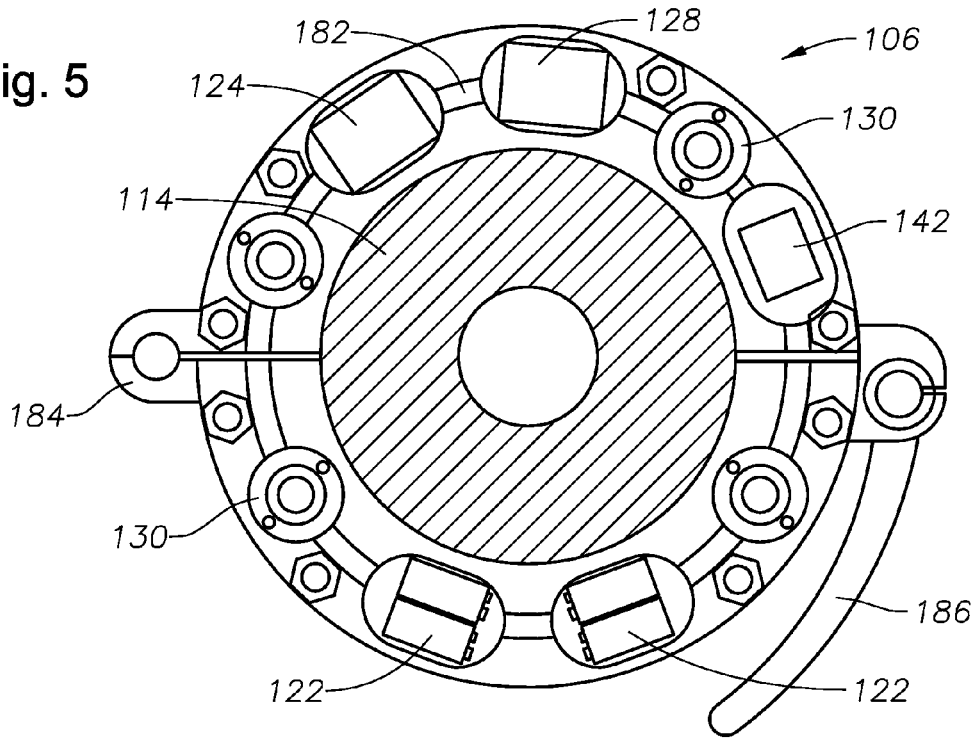
FIG. 5 is a top view of the surface transceiver of the frequency tone nesting indicator of FIG. 2.
Figure 6:
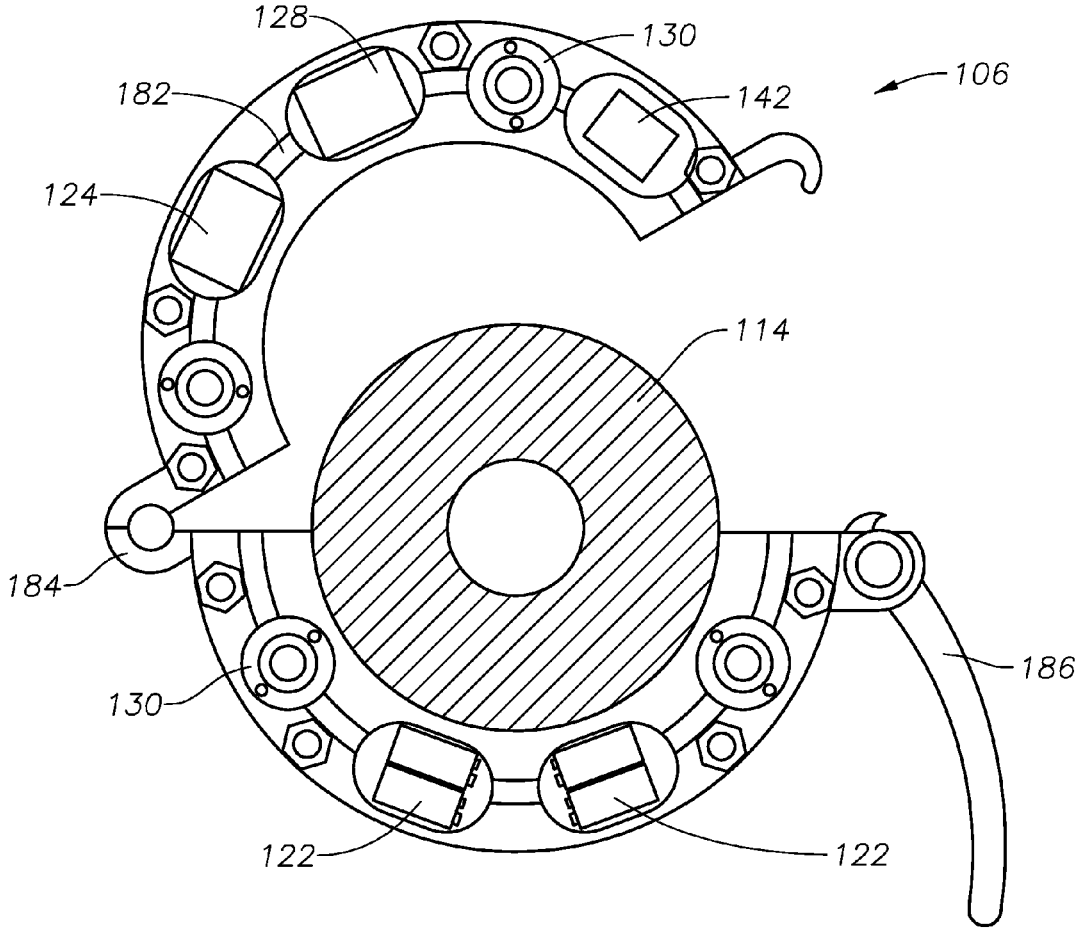
FIG. 6 is a top view of the unlatched position of the surface transceiver of the frequency tone nesting indicator of FIG. 2.
Figure 7:
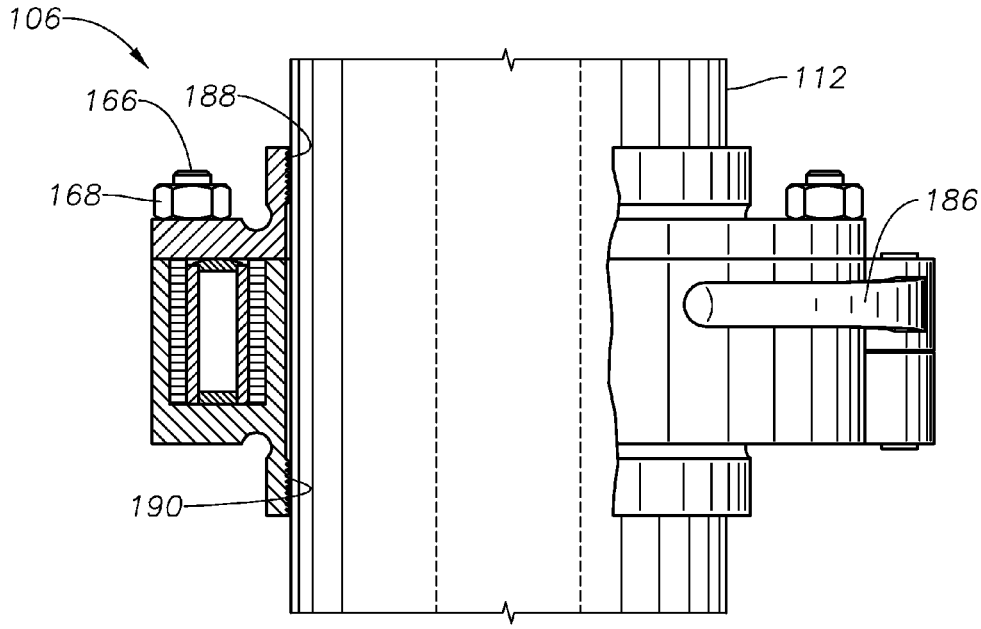
FIG. 7 is a sectional view of the surface transceiver of the frequency tone nesting indicator of FIG. 2.

Referring to FIGS. 5-7, surface transmitter and receiver ("surface transceiver") 106 is similar to signal ring 100. Surface transceiver 106 clamps to the drill string 102 at a location away from signal ring 100, such as above the surface of the sea on the drilling rig. Surface transceiver 106 may be used in other locations. In some embodiments, the components of surface transceiver 106 are similar to the components of signal ring 100. For example, surface transceiver 106 may have power supply 122, wave form generator 124, amplifier 128, and transmitter 130. The various components may be connected by wire channel 182.

Surface transceiver 106 may be a split ring, wherein the ring is separable into two semi-circular components. The semi-circular components may be clamped to drill string by hinge 184 and latch 186. The split ring may be attached to a drill string at any position on the drill string, even if the drill string is already joined to other sections of drill string ("made up"). Referring to FIG. 7, surface transceiver 106 may have upper wickers 188 on an inner diameter of its bore, located near one end, and lower wickers 190 on an inner diameter of its bore, located at the end opposite the upper wickers 188.

Referring back to FIG. 4, connector 126 connects the electronic components of signal ring 100 to vertical conductor bar 192 in tool stem 114. In a preferred embodiment, connector 126 is sealed so that water may not enter signal ring 100 from the point where vertical conductor bar 192 is attached. Connector 126 may be installed through an opening in the outer diameter of signal ring housing 112 and retained by retaining ring 194 that snaps into retainer ring groove 196. One or more connectors 198 may connect through or protrude from the ID of signal ring housing 112, wherein vertical conductor bar 192 may be attached to connector 198. Connector 198 may also have contacts 200 for attaching internal wires (not shown), wherein the internal wires go through passage 202 in signal ring housing 112. Passage 202 could be a vertical passage that intersects with wire channel 120. Alternatively, passage 202 could go in other directions and intersect with cavity 118. Internal wires (not shown) attach to the connector 126 and then connect to a component such as wave form generator 124. In some embodiments, wave form generator 124 provides current to vertical conductor bar 192. Wave form generator 124 may also include sensors for detecting the amount of electrical current passing from wave form generator 124 to vertical conductor bar 192. As will be described later, conditions such as the landing of casing hanger 108 or seal 110 will cause current to flow at a particular rate, subject to a particular resistance. Wave form generator 124 is able to detect the rate of current flow with sufficient accuracy to identify the event. In alternative embodiments, electricity may flow from any of the different components associated with signal generator assembly 100 to vertical conductor bar 192, and whichever component supplies power may also be able to detect the rate and resistance associated with the current flow. Some embodiments may not use a sensor, per se, but rather generate a frequency responsive to the level of current flowing out of the component.

Figure 8:
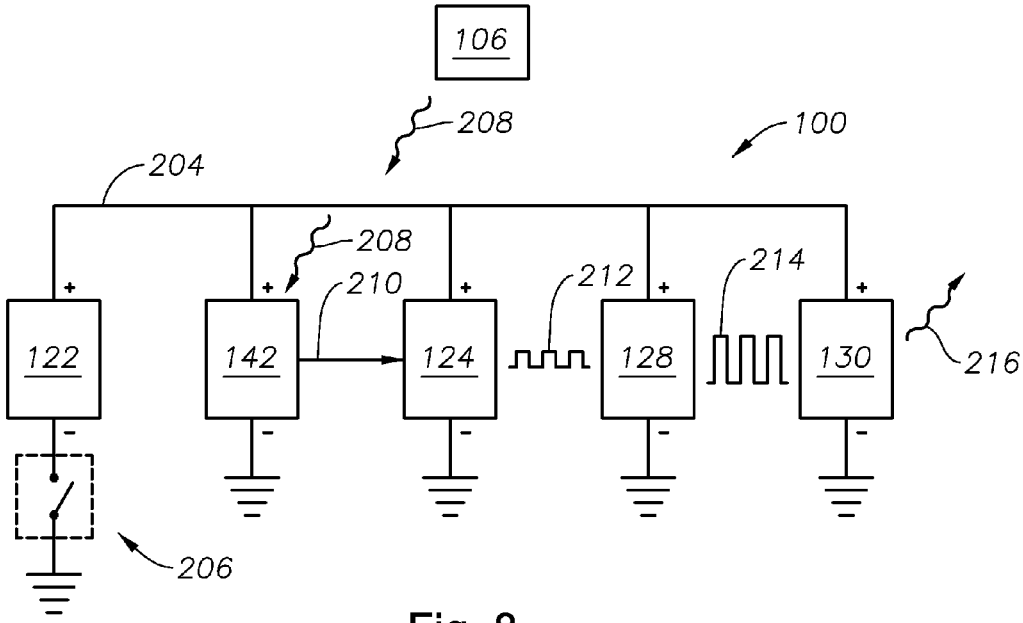
FIG. 8 is a diagrammatic view of the electrical components of an exemplary embodiment of the frequency tone nesting indicator of FIG. 2.

FIG. 8 is a connection diagram illustrating connections between various components in an exemplary embodiment. In an exemplary embodiment, components such as receiver 142, wave form generator 124, amplifier 128, and transmitter 130 are each connected by positive wire 204 to the positive connection of power supply 122. Each of the components may be grounded, such as by electrical connection to ring housing 112, in which case only positive wire 204 is required to provide power to each component. Switch 206 may be a power switch for energizing power supply 122. In an exemplary embodiment, switch 206 completes a path to ground from a negative contact of power supply 122.

Receiver 142 may include a digital phase lock loop ("PLL") capable of locking to any acoustic frequency that transmits through the drill string from the surface mounted acoustic transceiver. Thus when receiver receives surface signal 208 from the surface (via the drill string), receiver locks on to the acoustic frequency and transmits acoustic signal 210 to wave form generator 124 to cause wave form generator 124 to generate wave form signal 212 similar to surface signal 208.

In an exemplary embodiment, wave form generator 124 transmits wave form signal 212 to amplifier 128. Amplifier 128 amplifies signal 212 to create drive signal 214. Drive signal 214 has the same frequency as signal 212, but with a greater amplification. Drive signal 214 actuates transmitters 130, to produce transmitter output 216, which is the FSK signal that can resonate along the drill string.

Figure 9:
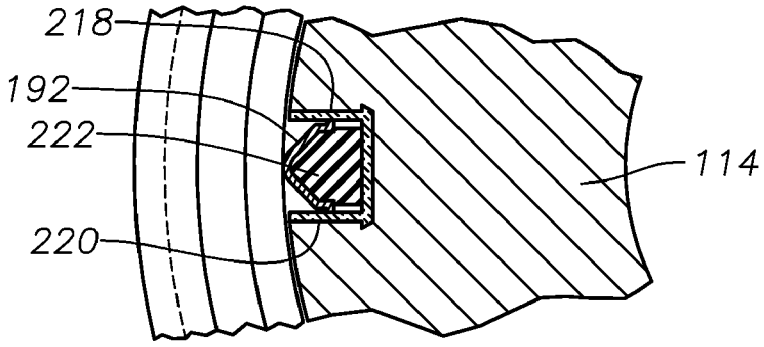
FIG. 9 is a cross sectional view, taken along the 9-9 line, of the conductor channel in the stem and the conductor ring in the casing hanger running tool of FIG. 2.

Referring to FIG. 9, tool stem vertical conductor bar 192 is an exposed conductor that transmits an electrical current along the length of tool stem 114. Tool stem vertical conductor bar 192 can be any device capable of passing an electrical current. In a preferred embodiment, vertical conductor bar 192 is a hard, wear resistant conductive material. In an exemplary embodiment, channel 218 on the side of tool stem 114 contains vertical conductor bar 192. Channel 218 may be lined by channel insulator 220, which is a non-conductive material such as plastic. In some embodiments, channel 218 is filled with resilient material 222. Resilient material 222 could be a resilient material such as, for example, a sponge type material or an elastomeric material, installed in channel 218 after channel insulator 220, followed by vertical conductor bar 192.

Figure 10:
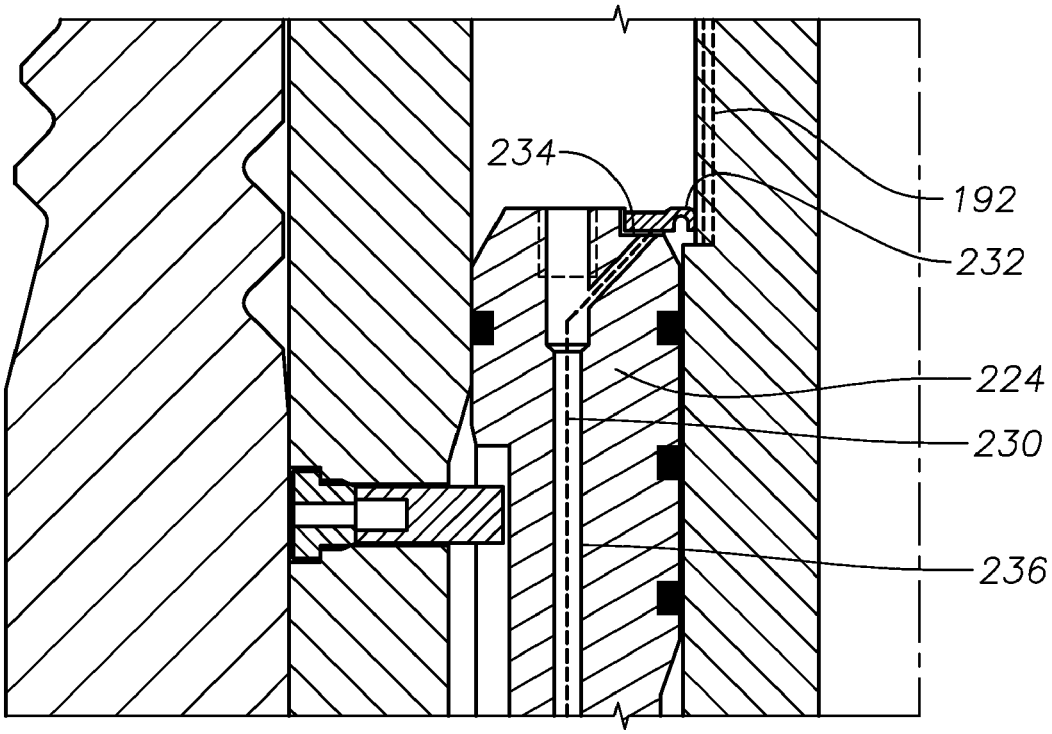
FIG. 10 is a sectional view of the ring contactor in the casing hanger running tool and the conductor channel in the stem connector of on the frequency tone nesting indicator of FIG. 2.

Referring back to FIG. 2, casing hanger running tool 224 attaches to tool stem 114. Running tool outer sleeve 226 may be attached to or a component of running tool 224. Running tool 224 is used to hold and run casing hanger 108 as well as hold, run and set seals 110. Referring to FIG. 10, running tool 224 has a running tool signal wire 230 to pass current from tool stem vertical conductor bar 192 to casing hanger 108 (FIG. 2). In some embodiments, the ID of the top of running tool 224 has a conductor ring 232. Conductor ring 232 contacts vertical conductor bar 192. The vertical length of vertical conductor bar 192 is exposed along part of the length of tool stem 114. Conductor ring 232 remains in contact with vertical conductor bar 192 as running tool 224 moves axially in relation to tool stem 114. Conductor ring 232 is able to remain in contact with vertical conductor bar 192 as running tool 224 rotates axially about tool stem 114.

Conductor ring 232 may be located inside groove 234 in the ID of running tool 224, and is attached to running tool signal wire 230. Signal wire bore 236 is a vertical bore between the ID and OD of running tool 224. The upper portion of bore 236, where conductor ring 232 is attached to signal wire 230, may be filled with a sealant such as epoxy, plastic, or rubber.

Figure 11:
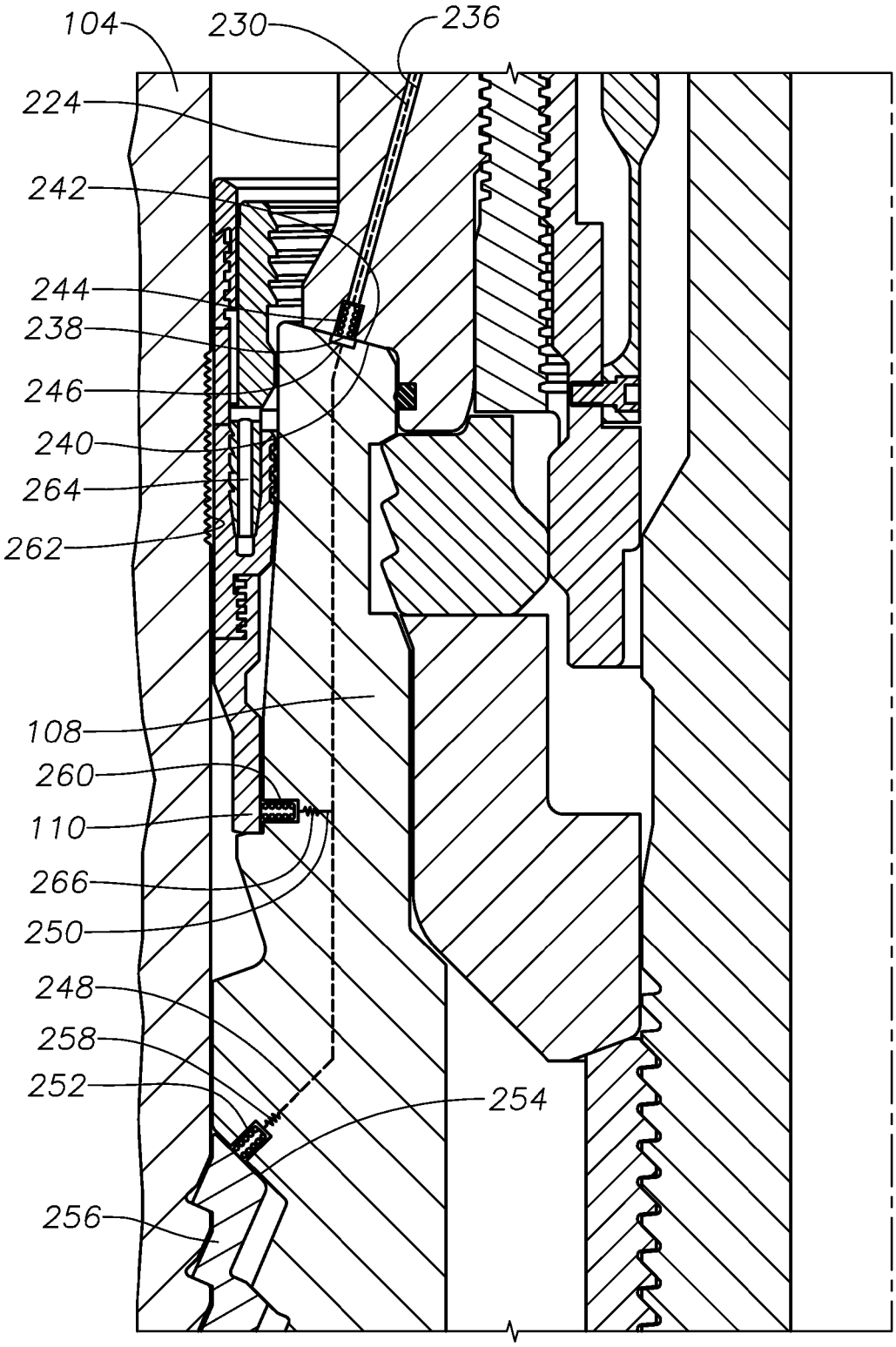
FIG. 11 is a sectional view showing the conductors and electrical contact points in the casing hanger and the lower portion of the casing hanger running tool of FIG. 2.

Referring to FIG. 11, Running tool signal wire 230 passes through bore 236 from conductor ring 232 to casing hanger connection point 238, located on shoulder 240 where running tool 224 engages upper face 242 on casing hanger 108. In an exemplary embodiment, connection 238 on running tool 224 may be on spring loaded plunger 244 wherein the spring causes the contact point to protrude from the surface and maintain contact between the running tool and casing hanger 108.

Casing hanger 108 may have a contact point 246 that protrudes from shoulder 242 of casing hanger 108. Contact point 246 leads to one or more grounding wires 248, 250. Hanger grounding wire 248 leads to a load shoulder contact point 252 that contacts support surface 254 of landing shoulder 256. Like the other contact points, load shoulder contact point 252 may be on a spring loaded plunger.

Power supply 122 (FIG. 4), provides power to a component such as wave form generator 124, which then provides power and senses current drain through connector 126 (FIG. 4), vertical conductor bar 192 (FIG. 10), conductor ring 232, and running tool signal wire 230, to grounding wire 248. In a preferred embodiment, resistor 258 is located in grounding wire 248 between casing hanger contact 246 and support surface contact point 252. Thus when casing hanger 108 lands on landing shoulder 256, a predetermined current is passed through grounding wire 248 to landing shoulder 256.

Some embodiments have seal grounding wire 250 that leads to seal contact point 260 on the sealing surface of casing hanger 108. Seal contact point 260 may be on a spring loaded plunger. Metal seal 110 may be inserted between sealing surface 262 and casing hanger 108. When metal seal 110 is properly inserted and pressed into place by energizing ring 264, the seal 110 will contact seal contact point 260. When seal 110 contacts seal contact point 260, it provides a path to ground for electrical current present on seal contact point circuit 250. Seal contact point circuit 250 may or may not have resistor 266. If resistor 266 is present, it may have a different resistance value than load shoulder grounding wire 248. Thus the amount of current passed through seal contact point 260 will be different than the amount of current passed through landing sub contact point 252.

Figure 12:
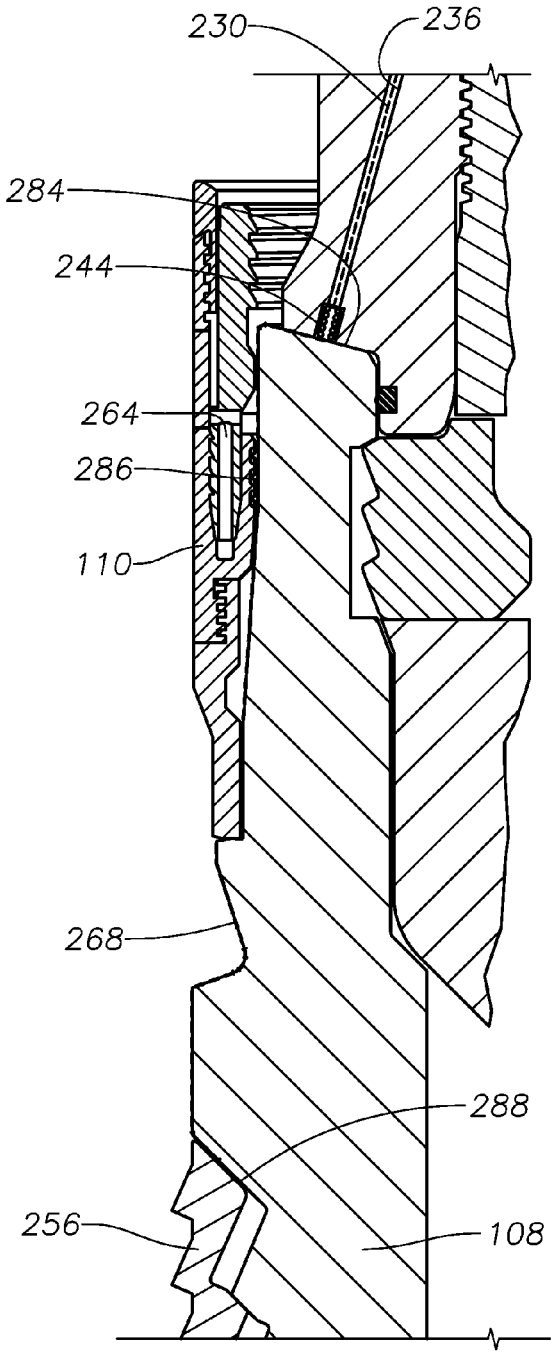
FIG. 12 is a sectional view showing an alternative embodiment of the casing hanger and lower portion of the casing hanger running tool of FIG. 2.
Figure 13:
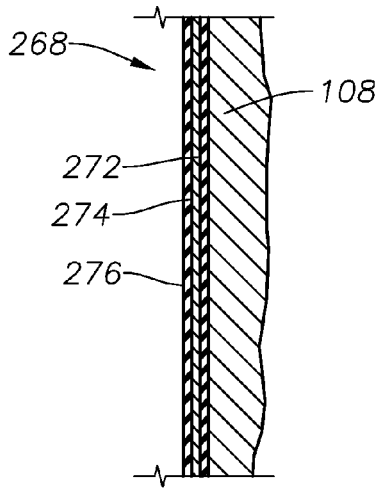
FIG. 13 is a cross sectional view of an exemplary embodiment of a conductive paint connector of the alternative embodiment of FIG. 2.

Referring to FIG. 12, in an alternative embodiment, conductor 268 is located on the exterior of casing hanger 108. Referring to FIG. 13, in some embodiments, conductor 268 is created by first applying a coat of insulative paint 272 to the exterior of casing hanger 108. Then semi-conductive paint 274 is applied over insulative paint 272. In some embodiments, outer insulator 276, which may also be insulative paint, is located on the exterior of semi-conductive paint 274.

Figure 14:
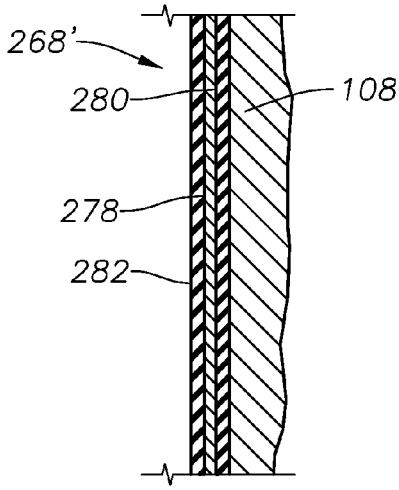
FIG. 14 is a cross sectional view of an exemplary embodiment of a conductive ribbon connector of the alternative embodiment of FIG. 2.

Alternatively, referring to FIG. 14, conductor 268' may be a piece of conductive ribbon 278, or tape, with an insulative backing 280. Ribbon 278 may be conductive, resistive foil. In some embodiments, a layer of insulative tape 282 may be located on the outer surface of conductive ribbon 278. Insulative backing 280 may have an adhesive coating for attaching to casing hanger 108.

Referring back to FIG. 12, conductive paint 274 (FIG. 13) and conductive ribbon 278 (FIG. 14) may be semi-conductive or electrically resistive materials. Thus electrical current passing through a long length of conductor 268 encounters greater resistance than electrical current passing through a short length of conductor 268. When an electrical current is applied to one end of conductor 268, and a point on conductor 268 is grounded, conductor 268 may serve as a type of strain gage. The resistance of conductor 268 varies depending on the distance between the electrical current and the grounding point.

Still referring to FIG. 12, in an exemplary embodiment, conductor 268 is applied to the exterior of casing hanger 108, extending from upper shoulder 284 along sealing surface 286 to landing surface 288. In operation, spring loaded plunger 244 contacts conductor 268 at shoulder 284, thus making an electrical connection between running tool signal wire 230 and conductor 268. When casing hanger 108 lands on landing shoulder 256, electricity flows from signal wire 230, through conductor 268, to landing shoulder 256. Landing shoulder 256 is grounded. Due to the length of conductor 268, between shoulder 284 and the grounding point at landing surface 288, conductor 268 has a first resistance value R1 when casing hanger 108 lands on landing shoulder 256.

When seal 110 is landed between casing hanger 108 and wellhead housing 104 (FIG. 2), seal 110 contacts conductor 268 and thus forms a path to ground between conductor 268, at sealing surface 270, and wellhead housing 104. The path to ground between conductor 268 and wellhead housing 104 has a resistance R2, which is a different resistance than resistance value R1. In some embodiments, electricity flows to both landing shoulder 256 and seal 110, and thus the current source, such as wave form generator 124 (FIG. 4), can detect the rate of current flow.

When energizing ring 264 sets seal 110, seal 110 pushes against conductor 268 with greater force than before seal 110 was set. In some embodiments, setting seal 110 causes seal 110 to engage conductor 268 with more surface area in contact than prior to being set, thus causing resistance R3 to be different than resistance R2. In other embodiments, setting seal 110 may cause seal 110 to sever conductor 268, thus allowing electricity to flow through seal 110 to ground, but stopping the flow of electricity through landing surface 288. Thus, while resistance R3 will be lower than resistance R1, the total resistance of R3 may be higher or lower than the combined resistance of R2 and R1.

Figure 15:
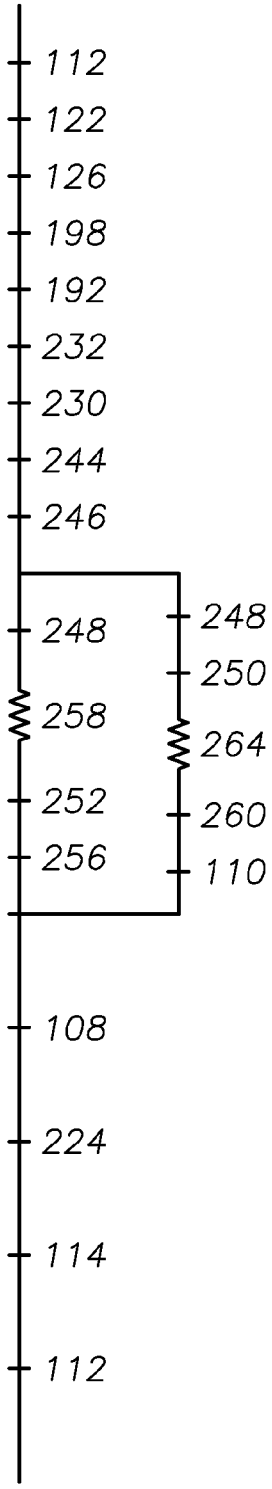
FIG. 15 is a schematic view of a signal path of an embodiment of the frequency tone generator of FIG. 2.

Referring to FIG. 15, in an exemplary embodiment having seal grounding wire 250 located within casing hanger 108, the circuit path from a component within ring housing 112, such as wave form generator 124, is as follows. The sensor current from power supply 122 passes through connector 126 to connectors 198, and then along vertical conductor bar 192 (which runs along channel 218 of running tool stem 114). Conductor ring 232, in contact with vertical conductor bar 192, passes the electricity to running tool signal wire 230, which runs to spring loaded plunger 244. Connection 238 of plunger 244 makes a connection with contact point 246 when running tool 114 is in contact with casing hanger 108. Electricity passes from contact point 246, through hanger grounding wire 248 and resistor 258, to contact point 252. Contact point 252 engages landing shoulder 256 when casing hanger 108 lands in landing shoulder 256. Electricity passes from landing shoulder 256 to ground. Casing hanger 108 is also grounded against landing shoulder 256, thus providing ground for running tool 224 and running tool stem 114, back to ring housing 112 and power supply 122. When seal 110 is set in place, electricity from contact point 246 flows through grounding wire 248 to seal grounding wire 250, which passes electricity to resistor 264 and to seal contact point 260. Seal contact point 260 contacts seal 110, which can then pass electricity to casing hanger 108. As described above, electricity flows through casing hanger 108 and back through running tool 224 and running tool stem 114 to ring housing 112 and power supply 122.

Figure 16:
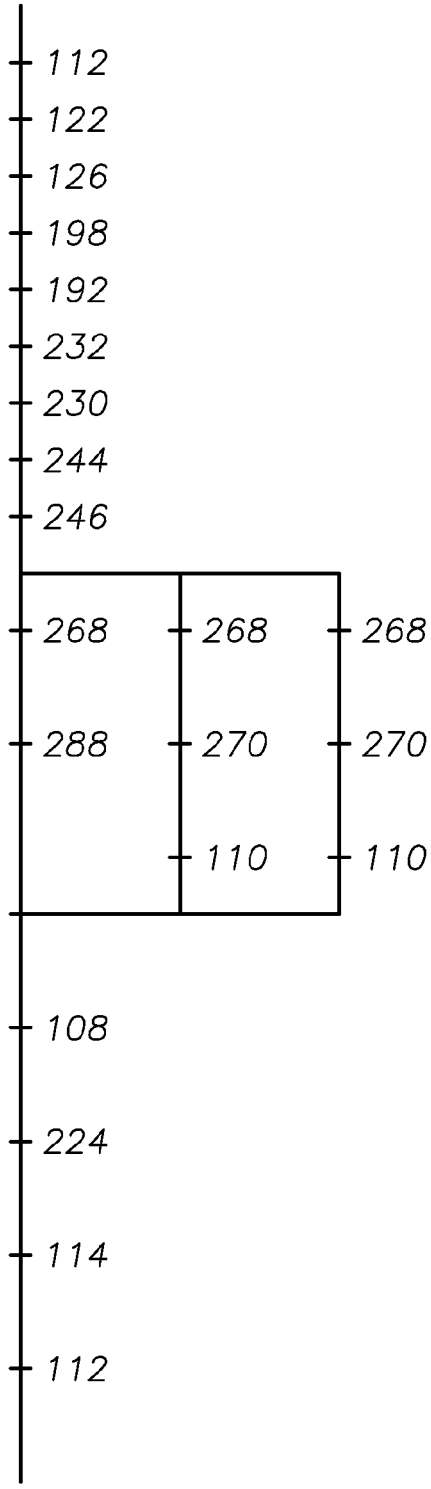
FIG. 16 is a schematic view of a signal path of an alternative embodiment of the frequency tone generator of FIG. 2.

Referring to FIG. 16, in an embodiment having external conductor 268 on casing hanger 108, electricity flows to connection 238 of plunger 244 and contact point 246 in the same manner as described in FIG. 12, but then flows through conductor 268 to landing surface 288, which contacts casing hanger 108 when casing hanger 108 lands on landing shoulder 256. When seal 110 first contacts sealing surface 270, electricity is able to flow from conductor 268, through sealing surface 270, to seal 110 at resistance R2. When seal 110 is set, the same path is followed, but with resistance R3.

Referring to back to FIG. 11, in operation, as the operator lowers casing hanger 108 through the riser (not shown) downward toward landing shoulder 256, wave form generator 124 (FIG. 4) energizes a circuit that comprises connector 126 (FIG. 4), tool stem vertical conductor bar 192 (FIG. 2), running tool signal wire 230, casing hanger load shoulder contact point 252, and seal contact point 260. Various embodiments may include more or fewer components. Electrical current is not able to pass through this circuit because it has no path to ground. When casing hanger 108 lands on landing shoulder 256, load shoulder contact point 252 lands on load shoulder 254 of landing shoulder 256. Upon contact, current is able to pass through load shoulder contact point 252 to landing shoulder 256, thus completing the circuit. Resistor 258 in the circuit limits the current drain.

The current source, such as wave form generator component 124 (FIG. 4), detects the current drain and the amount of the current drain. When the current drain matches a predetermined value consistent with the current drain associated with casing hanger 108 (FIG. 2) landing on landing shoulder 256 (FIG. 2), wave form generator 124 (FIG. 4) begins generating a square wave electrical signal.

Referring to FIG. 4, amplifier 128 amplifies the square wave signal, and the output is directed to frequency transmitters 130. Transmitters 130 begin driving hammer 136 into rigid surface 138 at the same frequency as the square wave signal. Wave form generator 124 alters the frequency through a predetermined range in order to generate at least one frequency that is able to resonate up the up the drill string 102 to the surface. The frequency of wave form generator 124 may ramp, for example, from approximately 500 Hz up to approximately 1800 Hz or more, and may ramp back down. When the band pass frequency reaches surface transceiver 106, the phase lock loop ("PLL") of surface transceiver 106 may lock onto the frequency, and then surface transceiver 106 wave form generator 124 will generate a confirmation signal having a similar frequency, causing surface transceiver 106 transmitter 130 to send a confirming frequency back through drill string 102, where a PLL located within ring assembly 100 may lock on to the confirmation signal and then communicate all remaining information at the same frequency as the confirmation signal.

Referring to FIG. 11, after landing casing hanger 108, the operator may drive seal 110 into place by lowering energizing ring 264 to push seal 110 to the proper location to form a seal between casing hanger 108 and landing shoulder 256. When seal 110 is properly located to form a seal, the seal will contact seal contact point 260, which creates a path to ground for the current originating from signal ring 100. Seal contact point 260 circuit does not have a resistor, or has resistor 266 that is different from resistor 258 located on load shoulder contact point grounding wire 248.

Referring to FIG. 4, the current source associated with signal ring 100 detects the amount of the current drain, which causes wave form generator 124 to generate a square wave signal. The wave form generated in response to seating seal 110 (FIG. 2) may be different than the wave form generated in response to landing casing hanger 108 (FIG. 2). As described above, the square wave signal drives transmitters 130 to transmit a frequency or range of frequencies that may resonate along the drill string 102.

Similarly, in the alternative embodiment using conductor 268, the current source associated with signal ring 100 detects the amount of current flowing from the current source. When the amount of current is consistent with resistance value R1, wave form generator 124 generates wave form signal 212 at a first frequency. When the current flow is consistent with resistance value R2, wave form generator 124 generates wave form signal 212 at a second frequency. Finally, when current flow is consistent with resistance value R3, wave form generator 124 generates wave form signal 212 at a third frequency. Wave form signal 212 is amplified by amplifier 128, to create drive signal 214, which drives transmitter 130 at the same frequency as wave form signal 214, but with greater amplitude.

While the invention has been shown or described in only some of its forms, it should be apparent to those skilled in the art that it is not so limited, but is susceptible to various changes without departing from the scope of the invention. For example, the system could be employed by providing indication of landing of other equipment, such as a tubing hanger and tubing hanger seal.

What is claimed is:

1. A nesting indicator comprising:

a running tool adapted to be lowered from a surface platform, on a conduit;

a wellhead member carried by the running tool to be inserted into a subsea wellhead;

a wave form generator connected to the running tool that generates a wave form in response to the wellhead member being seated on a surface inside the wellhead; and a frequency tone transmitter, electrically connected to the wave form generator and carried by the running tool, that, in response to receiving the wave form, generates a tone, the frequency tone transmitter being in engagement with the running tool so that the tone travels as a vibration through the running tool and the conduit to the surface platform.

2. The nesting indicator of claim 1, wherein the running tool comprises a neck, the neck being adapted to connect to the conduit, and further comprising a collar connected to a neck, the frequency tone transmitter being located in the collar.

3. The nesting indicator of claim 2, further comprising a wire extending from the collar to an electrical connection, the electrical connection completing a circuit when the wellhead member is seated on the surface inside the wellhead.

4. The nesting indicator of claim 1, further comprising a grounding circuit, wherein electrical current passes through the grounding circuit when the wellhead member is seated on the surface inside the wellhead; and wherein the wave form generator generates the wave form in response to the electrical current.

5. The nesting indicator of claim 2, wherein the frequency tone transmitter comprises a magnetostrictive material, the frequency tone transmitter generating the tone as a result of the magnetostrictive material repeatedly expanding, in response to the wave form, to cause a metal cap to impact an interior surface of the collar.

6. The nesting indicator of claim 1, wherein the wave form generator generates the wave form at a predetermined frequency, and wherein the tone generated by the frequency tone transmitter has the same frequency as the wave form.

7. The nesting indicator of claim 3, wherein the wire completes at least a portion of a second circuit in response to a second wellhead member being seated on a second surface inside the wellhead to cause the wave form generator to generate a second wave form.

8. The nesting indicator of claim 1, wherein the tone transmitter comprises an annular winding, the annular winding generating a magnetic field in response to the wave form.

9. The nesting indicator of claim 2, wherein the tone transmitter is located in an annular cavity inside the collar.

10. The nesting indicator of claim 2, wherein the collar comprises two semi-circular body elements, the body elements connecting to each other to form an annular ring around the neck.

11. The nesting indicator of claim 2, wherein the nesting indicator is powered by at least one battery, the at least one battery being located inside the collar.

12. A nesting indicator comprising:

a running tool adapted to be lowered from a surface platform, on a conduit, the running tool having a neck adapted to connect to the conduit and a collar connected to the neck;

a wellhead member carried by the running tool to be inserted into a subsea wellhead;

a wave form generator located in the collar, the wave form generator generating a wave form in response to the wellhead member being seated on a surface inside the wellhead; and a frequency tone transmitter, electrically connected to the wave form generator and located in the collar, that, in response to receiving the wave form, generates a tone, the frequency tone transmitter contacting an interior surface of the collar so that the tone travels as a vibration through the running tool and the conduit to the surface platform.

13. The nesting indicator of claim 12, further comprising a wire extending from the collar to an electrical connection, the electrical connection completing a circuit when the wellhead member is seated on the surface inside the wellhead.

14. The nesting indicator of claim 12, wherein the frequency tone transmitter comprises a magnetostrictive material, the frequency tone transmitter generating the tone as a result of the magnetostrictive material repeatedly expanding, in response to the wave form, to cause a metal cap to impact the interior surface of the collar.

15. The nesting indicator of claim 13, wherein the wire completes at least a portion of a second circuit in response to a second wellhead member being seated on a second surface inside the wellhead to cause the wave form generator to generate a second wave form.

16. The nesting indicator of claim 12, wherein the tone transmitter comprises an annular winding, the annular winding generating a magnetic field in response to the wave form.

17. The nesting indicator of claim 12, wherein the collar comprises two semi-circular body elements, the body elements connecting to each other to form an annular ring around the neck.

18. A nesting indicator comprising:

a running tool adapted to be lowered from a surface platform, on a conduit, the running tool having a neck adapted to connect to the conduit and a collar connected to the neck;

a wellhead member carried by the running tool to be inserted into a subsea wellhead;

a conductor extending from the collar to an electrical connection, the electrical connection completing a circuit when wellhead member seated on the surface inside the wellhead;

a wave form generator located in the collar, the wave form generator generating a wave form in response to the wellhead member being seated on a surface inside the wellhead; and a frequency tone transmitter, electrically connected to the wave form generator and located in the collar, the frequency tone transmitter comprising an annular winding, the annular winding generating a magnetic field in response to the wave form, and a magnetostrictive material, the frequency tone transmitter generating a tone as a result of the magnetostrictive material repeatedly expanding, in response to the wave form, to cause a metal cap to impact an interior surface of the collar to send a vibration through the collar and the running tool to the conduit, the vibration travelling through the conduit to the surface platform.

* * * * *